US012303802B2

(12) United States Patent
Barr

(10) Patent No.: US 12,303,802 B2
(45) Date of Patent: May 20, 2025

(54) MULTILAYERED MODEL ASSEMBLIES

(71) Applicant: Zootility Co., Portland, ME (US)

(72) Inventor: Nathan Barr, Portland, ME (US)

(73) Assignee: Zootility Co., Portland, ME (US)

( * ) Notice: Subject to any disclaimer, the term of this patent is extended or adjusted under 35 U.S.C. 154(b) by 209 days.

(21) Appl. No.: 17/824,615

(22) Filed: May 25, 2022

(65) Prior Publication Data

US 2022/0379231 A1 Dec. 1, 2022

Related U.S. Application Data

(60) Provisional application No. 63/192,891, filed on May 25, 2021.

(51) Int. Cl.
*A63H 33/10* (2006.01)
*A63H 33/04* (2006.01)
*A63H 3/16* (2006.01)

(52) U.S. Cl.
CPC ..... *A63H 33/107* (2013.01); *A63H 33/042* (2013.01); *A63H 3/16* (2013.01)

(58) Field of Classification Search
CPC ..... A63H 33/107; A63H 33/042; A63H 3/16; A63H 17/002; A63H 33/12
USPC ..... 446/85, 93, 97, 99, 100, 101, 108, 109, 446/111, 116, 120, 121, 124, 128
See application file for complete search history.

(56) References Cited

U.S. PATENT DOCUMENTS 1,777,948 A * 10/1930 Van Eerde ..... A63H 3/16 446/99
2,116,853 A * 5/1938 Stelle ..... A63H 3/10 446/376
D146,426 S * 3/1947 Berger ..... D21/585
2,457,249 A * 12/1948 Lipschitz ..... A63H 3/16 446/97
2,482,334 A * 9/1949 Fernald ..... A63H 3/46 446/379
9,056,260 B2 * 6/2015 Barcelo ..... A63H 33/101
2003/0203702 A1 * 10/2003 Germerodt ..... A63H 33/105 446/85
2008/0261484 A1 * 10/2008 Culpepper ..... A63H 3/16 446/124

* cited by examiner

*Primary Examiner* — Nini F Legesse
(74) *Attorney, Agent, or Firm* — Verrill Dana, LLP; Robert L. Hover

(57) ABSTRACT

Toy model assemblies of multiple planar layer pieces mechanically fastened together with adjustable connectors. Models incorporating the multilayered assemblies can be made to hold their position when the adjustable connectors are tightened. The layer pieces have profiles that represent specific model components some of which rotate about a perpendicular connector in parallel planes. Stratified layer assemblies capturing a specialized connector provide rotation on an axis in the same plane as capturing layers. The model layer pieces are preferably all the same thickness and cut from sheets of quality plywood.

13 Claims, 12 Drawing Sheets

MULTILAYERED MODEL ASSEMBLIES

CROSS-REFERENCE TO RELATED APPLICATIONS(S)

This application claims priority to U.S. Provisional Application No. 63/192,891, filed May 25, 2021, entitled "MULTILAYERED MODEL ASSEMBLIES" which is incorporated herein by reference in its entirety.

FIELD OF THE INVENTION

This disclosure relates generally to constructible toy models and more specifically to models having assemblies of multiple layer pieces of similar materials mechanically laminated to construct models that can be posed in variable positions.

BACKGROUND OF THE INVENTION

Constructible toy models are known to promote STEM skills such as spatial reasoning, problem solving, and decision making while improving a child's manual dexterity. Such models have become increasingly popular and may be chosen to resemble such things as animals, vehicles, and dwellings. Well known brands of such toys include Lincoln Logs®, K'Nex®, and Tinkertoy®.

Variations of self-assembled toy products are commonly made of plastic or slotted sheets of plywood. Many are complex and time-consuming to complete. Wood is favored but slotted plywood designs generally lack the durability of solid wooden toys because pieces are usually loosely slotted together. Solid wooden toys are considerably sturdier but are often one dimensional and have limited mobility. Wooden toys offering a range of motion typically rotate around a single axis. Plastic toys commonly have greater ranges of motion but are not as pleasing and involve intricate molding dies to manufacture.

Accordingly, there is a need for improved buildable toy models that are interesting to children yet are easy to construct. The present invention provides for durable, dynamic, three dimensional models with multiple rotating layer assemblies. Layer pieces of the models are readily manufactured and efficient to ship. The models may be constructed with little or no tools and the rotating assemblies from which they are made may be adjusted to resist movement, allowing such models to hold a range of different positions

SUMMARY OF THE INVENTION

Model assemblies of the present invention are comprised of a multitude of layer pieces mechanically held together with connectors. The layer pieces are generally planar and have at least one perpendicular bore. The layer pieces have profiles that represent particular features of a model. Preferably, each of the layer pieces is cut from a single planar sheet so that each layer is similar in thickness and of the same appearance and texture.

Layer pieces are connected together by fastening the connectors through bores of two or more layer pieces. When the layers are assembled, they are positioned in alignment so that a single connector may penetrate the bores of multiple layers.

Connectors of the present invention comprise a central stem with heads at opposite ends. The stems are sized to fit through the bores while the heads are wider than the bores of layer pieces. Depending on the particular model assembly, some of the connectors allow rotational movement between the layers while other connectors simply secure multiple layers side by side or prevent rotation of certain parallel layers.

Connectors allowing rotational movement of the layer pieces are adjustable for length, so that they may provide a clamping action that impedes or prevents rotation of layer pieces in contact with each other while situated in parallel adjacent planes.

Preferably connectors of the present invention are barrel nut and mating screw type connectors having flat, slotted screw heads at opposite ends. Such connectors are adjustable for length and may be shortened or tightened using a flat blade screwdriver to turn one of the heads.

In some embodiments of the present invention, the model layer pieces are not completely cut free from a planar sheet but are provided still attached, with profiles of the layer pieces perforated through the planar sheet material. Along with the perforated planar sheet material are a set of connectors to be used for constructing a model. In these embodiments, model assemblies of the present invention are provided as a kit for being constructed by a model making consumer. In preferred embodiments, the sheet material is plywood and a tool may be provided in the kit to help fasten the connectors. In other embodiments of the present invention layer pieces are provided in a kit completely cut free from a planar sheet. In still other embodiments, models are provided fully assembled.

Some preferred embodiments of the present invention are constructed with a swivel joint connecting two sets of layer pieces. The joint is comprised of a connector captured between and running parallel to the layer pieces of each set. In some preferred embodiments having a swivel joint, the connector is fitted with washer blocks at each end to facilitate the capture of the connector between the layers.

DETAILED DESCRIPTION OF THE INVENTION

Figure 1:
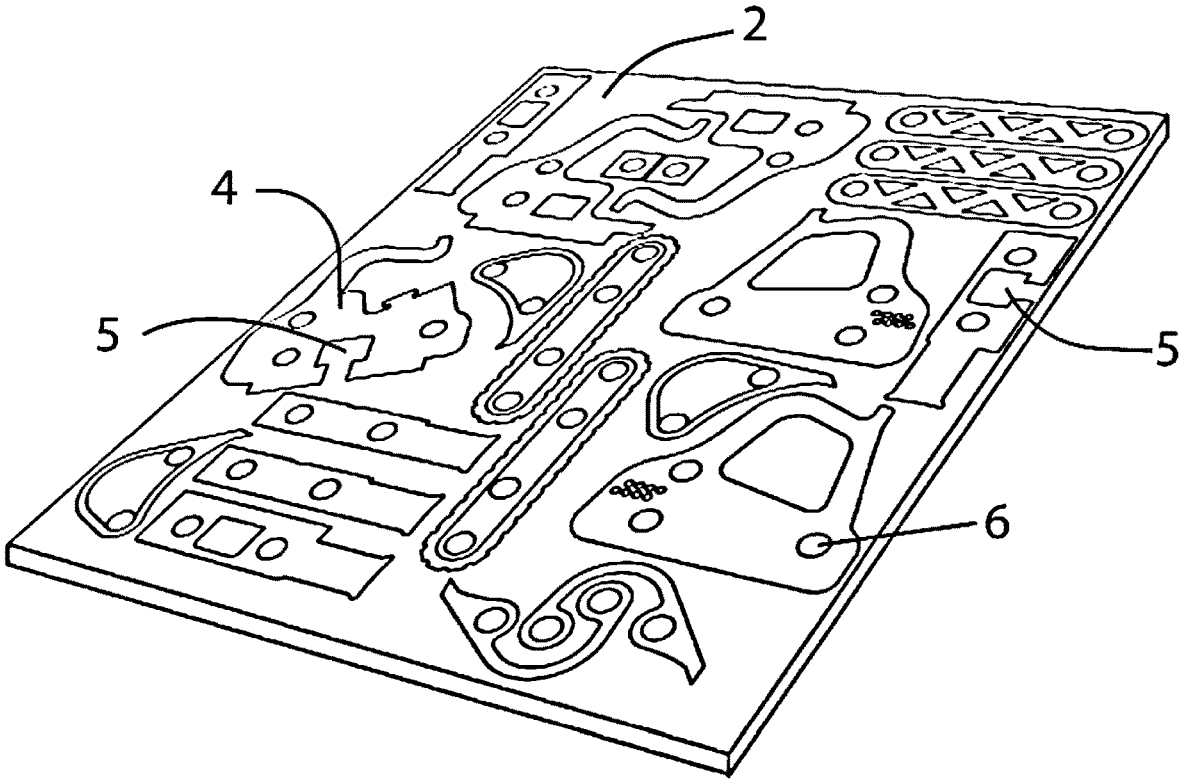
FIG. 1 is one sheet of perforated layer pieces for assembling a multilayered model.

This description will show and describe various stratified layer toy model assemblies. The assemblies are useful for constructing models that may be built from planar components sharing a common thickness. Preferably, the planar components are made of wood and provided together as perforated parts residing in planar sheets along with connectors of suitable lengths.

Although this disclosure presents only a limited number of model assembly embodiments, numerous combinations and modifications can be made of the features shown and described while keeping within the scope of the present invention. No limitation with respect to the particular embodiments disclosed herein is intended or should be inferred.

The following terms are provided for the purpose of description and not limitation.

The term "appendage layer" is intended herein to refer to a layer attached to and rotating between a first and third layer about a connector positioned at the distal end of the first and third layer.

When used herein, the term "bore" is intended to connote a round void extending completely through one or more planer components. When referring to a layer comprising sublayers and having a bore, the bore is understood to penetrate all sublayers of the layer.

The term "extremity layers" is intended to refer to a layer or layers attached to and rotating alongside an appendage layer about a connector positioned at the distal end of an appendage layer.

As used herein, the term "layer" or "sublayer" often connotes function. The function of a layer depends on its attachments in a particular assembly structure. Layers attached to multiple assembly structures may have multiple functions. For example, a layer may perform as a "second layer" that rotatably connects with a first and third layer in one assembly and the same layer may function as a "primary layer" to capture a connector washer block. Moreover, similar layer assembly structures may be used for different parts of a single model having distinct pieces that share the same name.

A specifically named layer may be comprised of several layer pieces or sublayers. Multiple sublayers that increase the thickness or width of a particular assembly may be referred to as one layer. The naming of a layer in a particular assembly depends on its functional relationship to other planar components of that assembly. Layer pieces with different functional relationships may be referred to as different layers although they may reside in the same plane.

The term "profile" when used herein, is intended to refer to the outermost edge defining the shape of a layer from a side perspective view.

The term "subassembly" is intended to refer to a set of one or more planar layers attached together that serve to be attached to another set of planar layers by at least one connector.

Referring now to the drawings, layer names and like reference characters may designate corresponding parts between similar layer assemblies.

Shown in FIG. 1 is part of an excavator model kit of the present invention. The kit comprises several planar sheets of plywood roughly ¼ of an inch thick. Perforations cut into the sheets circumscribe numerous shapes representative of assemblies to be constructed for a model. When removed from the sheet 2, the pieces are assembled in layers with connectors that are also included in the kit.

The layer pieces 4 of the kit comprise at least one perpendicular bore 6 for being attached to another layer piece using one of the many connectors. (Not shown) Some layer pieces are cut with a profile having a "T" shaped void 5 for attachment to a specialized connector. Layer pieces attached together with only one connector rotate with respect to each other and can be arranged to place the model in any one of many positions. The amount of force necessary to position the layers with respect to one another may be adjusted by tightening or loosening applicable connectors. The model may be made to hold a particular position when the connectors allowing rotation are sufficiently tight.

Figure 2:
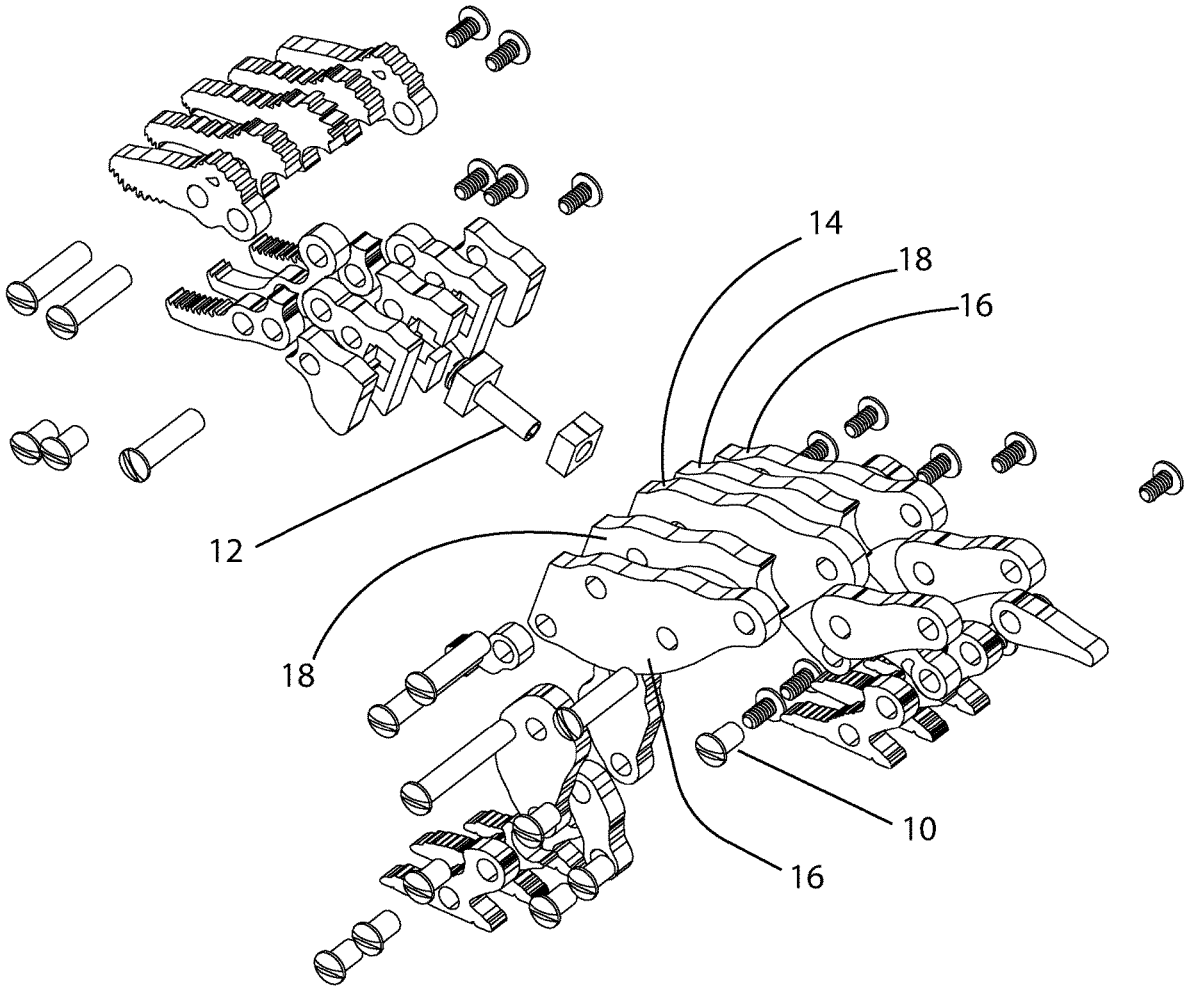
FIG. 2 is an exploded view of a multilayered dinosaur model having layer pieces with profiles representing anatomical components.

Shown now in FIG. 2 is an exploded view of a toy dinosaur model comprised of multiple overlapping assemblies according to the present invention. The stratified layers are attached together using connectors 10 that vary in length depending on the number of layers that the connector must pass through for fastening. The layers are shaped to have profiles which represent particular anatomical features of the dinosaur.

Multiple layer assemblies form a head, neck, body, tail, arms, legs and other aspects of the dinosaur model. Various assemblies may be moved so that the model may be made to hold a specific pose. In addition to being specifically shaped, layers representing the sides of the dinosaur head comprise surface detailing to accent the nostrils and eyes.

When the dinosaur model is assembled, all connectors run perpendicular to the plane of the layers except one. A single connector runs parallel or in alignment with the planes of the stratified layers. The parallel connector 12 is part of a swivel joint assembly allowing the neck of the model to turn with respect to the body. The parallel connector is positioned in a sublayer of the body portion that is midway through the model.

The midway sublayer 14 is larger in profile than the sublayers between which the midway sublayer is flanked. Similarly, the outside sublayers 16 of the body portion have a smaller profile than the flanking sublayers 18. This mirrored form of body sublayer arrangement provides a rounded appearance to the body. A similar mirrored order of successively smaller layer profiles is also used to round the appearance of the head and feet of the dinosaur model.

Figure 3:
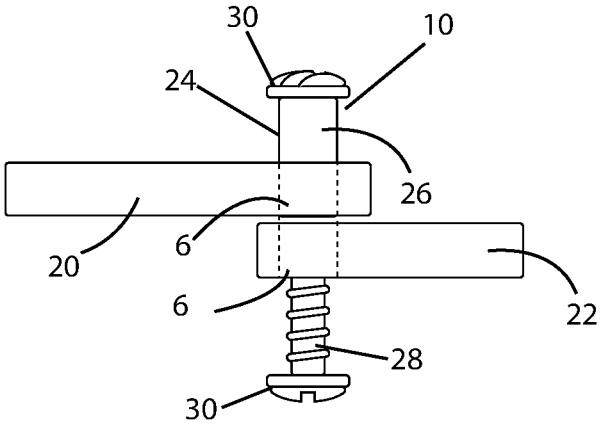
FIG. 3 is a semi-exploded view of two layers of a multilayered model assembly being rotatably attached with an adjustable connector.

Some layers of model assemblies in accordance with the present invention are fixed to each other with a single connector and rotate in adjacent parallel planes. Shown in FIG. 3 is an assembly comprising a first layer 20 and a second layer 22 along with a connector 10 that has not yet been completely installed through the perpendicular bores of the layers. The layers are of the same material thickness and the bores 6 receiving the connector 10 are shown to be aligned. In addition to the pair of bores receiving the connector, the first layer and the second layer have additional bores (not shown) that allow them to be attached to other layer pieces.

The connector 10 is itself comprised of a barrel nut and mating screw. The barrel nut 24 comprises an internally threaded stem 26 that fits closely in the bores of the layers. The mating screw 28 comprises an externally threaded portion that engages with the threads of the barrel nut. The barrel nut and mating screw of the connector have slotted, flat heads 30 that are larger in diameter than the bores of layer pieces. When the connector is placed through the bores of the first layer and second layer and tightened, the heads make contact with the sides of the layers.

The length of the connector is a suitable length so that when it is tightened the connector will sufficiently clamp the first layer and the second layer and significantly impede rotation of the layers about the stem of the connector. With the connector properly adjusted, the layers may be rotated when a small force is applied yet still maintain their orientation otherwise. The layer assembly of FIG. 3 and other assemblies shown and described herein may be used in numerous different types of models.

Models of the present invention are constructed as assemblies of stratified layer pieces. A partial body of a toy dinosaur model is shown FIG. 4 comprising one of the outside sublayers and two filler layers or sublayers that in combination with additional sublayers give the model body appropriate width. Leg and tail assemblies that connect to the body are also comprised of multiple layers. The leg of the model is shown as partially constructed and is comprised of a first layer 20 rotatably attached by a first connector 10 to a second layer 22 having a body profile. The first and second layers comprise bores in alignment, through which the first connector 10 extends. The profile of the first layer 20 is that of a dinosaur thigh and is duplicated by a third layer 32, positioned below or under the second layer 22 in FIG. 4. The third layer 32 of the leg assembly is also penetrated by the first connector 10.

Movement of the first layer 20 and third layer 32 of the leg assembly with respect to the second layer 22 is limited by a stop 34. The stop 34 is provided by the profile of a filler layer 36 in the same plane as the third layer of the leg assembly. The stop 34 of the filler layer 36 interferes with rotation of the third layer 32 on the first connector 10.

The first layer and third layer of the leg assembly each also comprise a second bore. The second bore 38 of the first layer is in alignment with the second bore of the third layer (Not shown). The first layer and the third layer are attached to each other with a second connector 42 extending through each of the second bores.

Between the first layer 20 and the third layer 32 of the leg assembly is an appendage layer 44 that corresponds with the shin of the dinosaur model leg. The appendage layer 44 comprises a proximate end 46 and a distal end 48. The proximate end 46 of the appendage layer contains a proximate bore (not shown) penetrated by the second connector 42, allowing the appendage layer 44 to rotate between the first layer 20 and the third layer 32 of the leg assembly in an adjacent parallel plane.

The distal end 48 of the appendage layer 44 is fitted with distal bore 52 perpendicular to the plane of the appendage layer. The distal bore 52 is sized to be fitted with a third connector (not shown) that will provide a rotatable connection for extremity layers of the dinosaur model foot.

Figure 4:
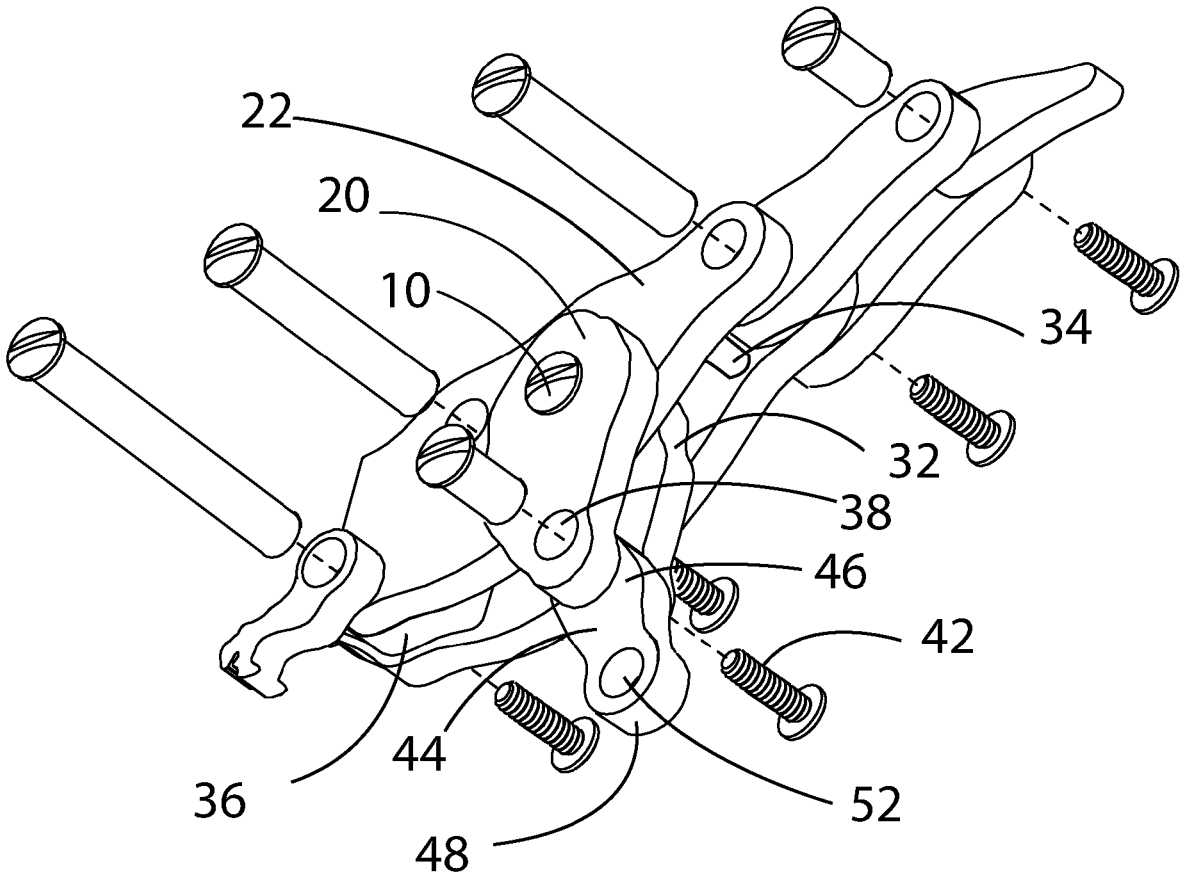
FIG. 4 is part of a dinosaur model showing first, second, and third layers of a leg assembly.
Figure 5:
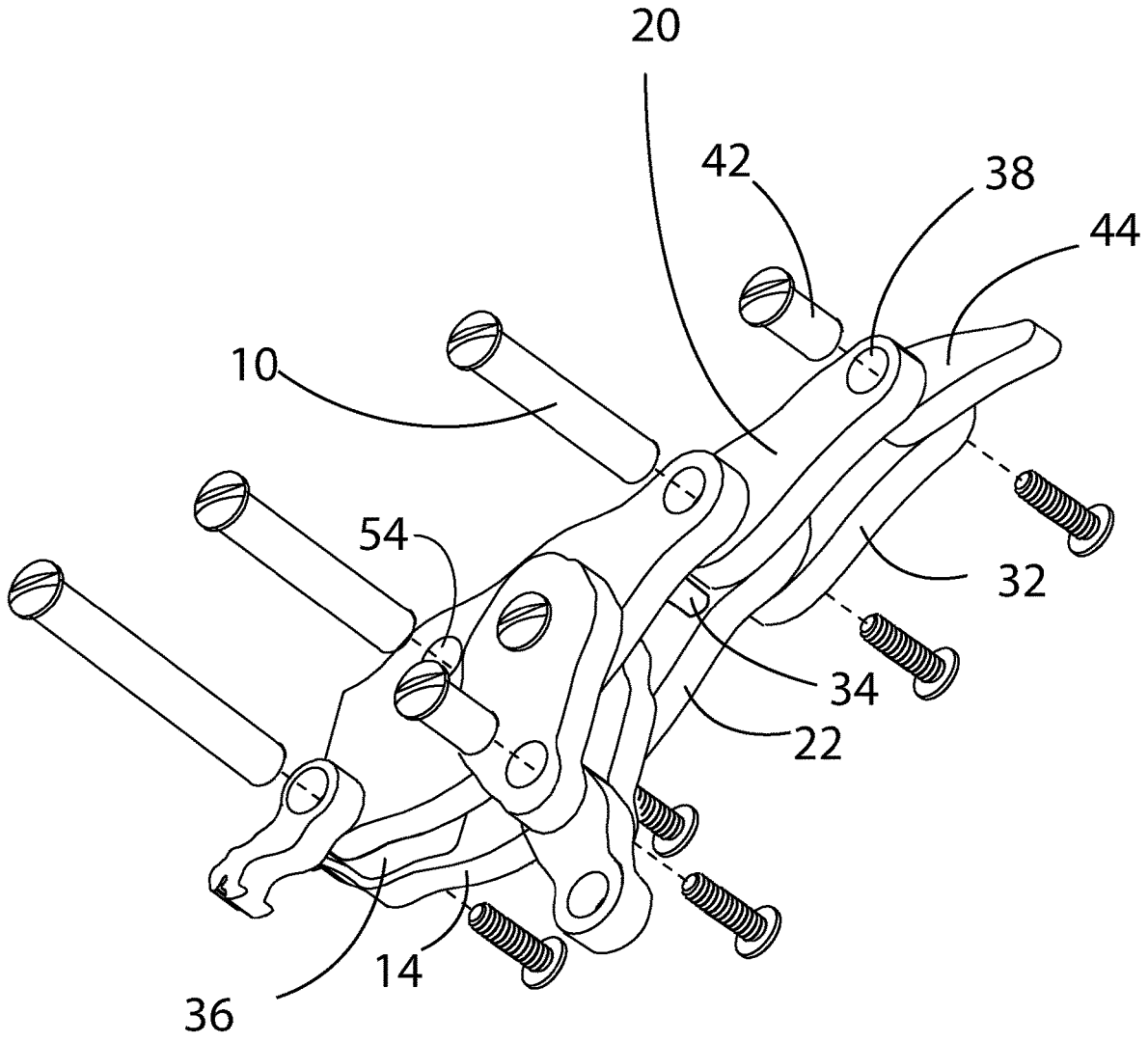
FIG. 5 is part of a dinosaur model showing first, second, and third layers of a tail assembly.

The model dinosaur body serves as the second layer of both the leg and tail assemblies shown in FIGS. 4 and 5. Referring now to FIG. 5, overlapping the leg assembly described above is a tail assembly of similarly arranged layers. A first layer 20 of the tail is comprised of a profile that represents the base of a dinosaur tail. Like the first layer of the leg, the first layer of the tail has perpendicular bores at opposite ends. Similarly, the third layer 32 of the tail comprises a profile and bores in alignment with the first layer of the tail. The bores of the first layer and third layer most proximate to the body are penetrated by a first connector 10 of the tail assembly. Rotatably attached between the first and third layers of the tail is a second layer 22 also having a bore penetrated by the first connector 10 of the tail assembly.

Opposite the end of the first and third layers of the tail assembly having the first connector 10 is a second connector 42 preventing rotation of the first layer 20 and the third layer 32 with respect to each other. Similar to the leg assembly, the second connector 42 of the tail assembly extends through a second bore 38 of the first layer and a second bore of the third layer. (second bore of third layer not shown) At the distal end of the first and third layer of the tail assembly is an appendage layer 44 with a bore that is penetrated by the second connector 42 of the tail between the first and third layers. In the case of the tail assembly, the appendage layer is comprised of a profile representing the tip of a model dinosaur tail.

The second layer 22 of the tail assembly shown in FIG. 5 is also a midway sublayer 14 or filler layer of the dinosaur body. In addition to supporting the first layer and second layer of the tail assembly, the midway sublayer 14 provides added thickness to the model body. Although not in the same plane, the second layer of the tail assembly is incorporated with and made part of the second layer of the leg assembly. In an adjacent parallel plane to the midway sublayer 14 and in the same plane as the third layer of the leg assembly and first layer 20 of the tail assembly, the filler layer 36 comprises a stop 34 that limits the rotation of first and third layers of the tail assembly by interfering with the first layer 20 of the tail assembly as the tail is rotated downward. A similar stop, not shown, is provided by the filler layer 36 in the same plane to limit rotation of the first layer 20 of the tail as the tail is rotated upward.

In some embodiments, a profile of a filler layer forms an arc that is closely fitted and concentric with a rounded end of a first or third layer rotating about a pivoting connector. Each end of the arc serves as a stop, one of which eventually comes into contact with the first or third layer when the layer is pivoted to its limit in either direction.

Referring again to FIG. 5, sublayers of the body are held together and prevented from rotating with respect to one another by a fastening connector that extends through a fastening bore 54 of all body sublayers. The bodies of the dinosaur models shown in FIGS. 4 and 5 are complete when a flanking filler layer and an outer sublayer is added below the midway sublayer of the body, and the sublayers are organized in mirrored form. Similarly, other sets of stratified layers of the model may be cut with slightly different profiles to better represent the subject of a particular assembly.

Figure 6:
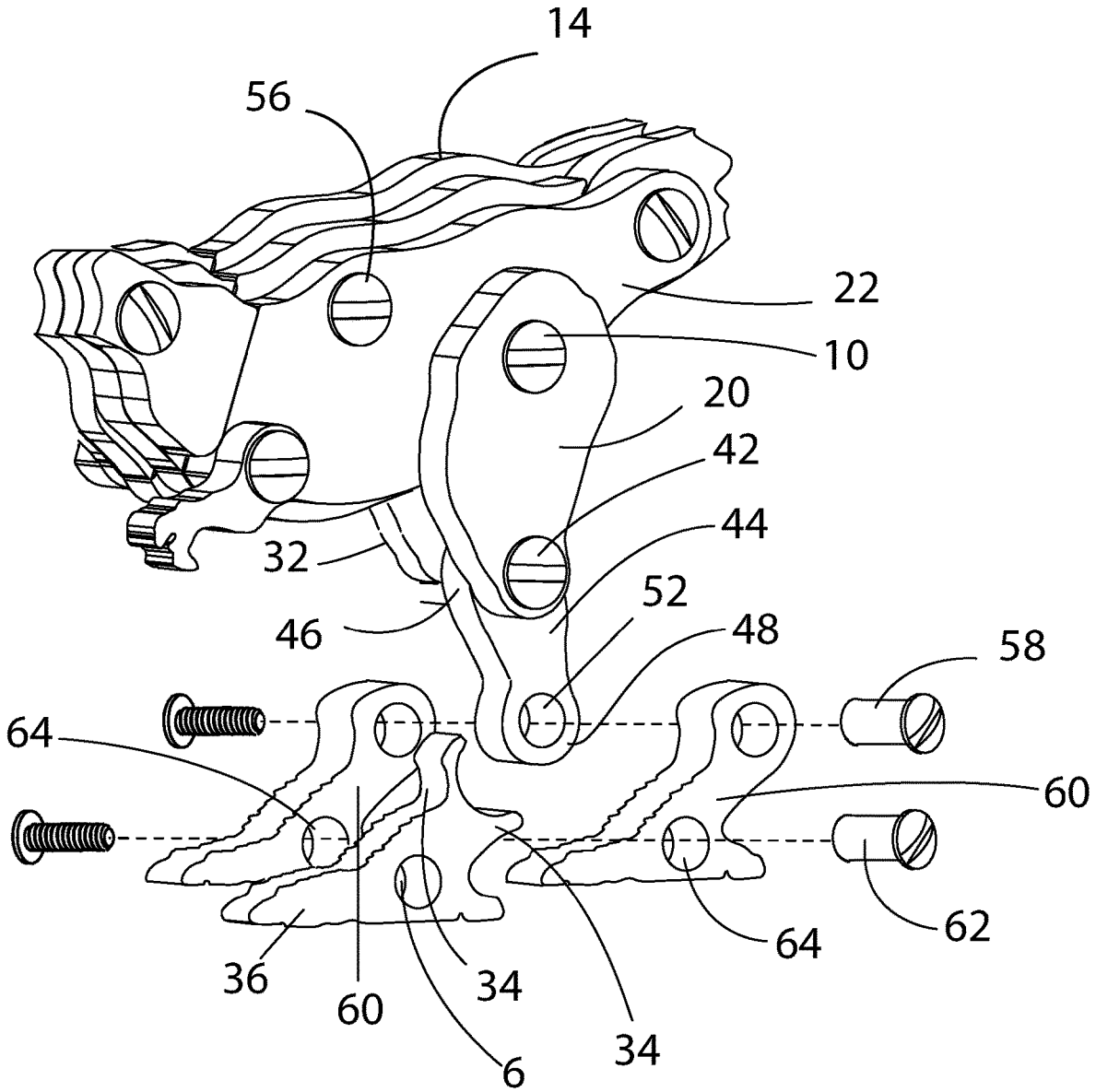
FIG. 6 is part of a dinosaur model showing different profiles of body layers and extremity layers representing a dinosaur foot.

Shown in FIG. 6 is a portion of the toy dinosaur model of FIGS. 4 and 5 having extremity layers of the leg assembly exploded. Sublayers 14 of the dinosaur body are slightly different from one another in profile, giving a rounded appearance to the body. Together, the stratified sublayers of the body form a second layer 22 to which the first layer 20 and the third layer 32 are rotatably attached by a first connector 10 extending through the body at an axis perpendicular to the planes of the stratified layers. The sublayers of the body are further fastened together and prevented from rotating with respect to one another by a fastening connector 56 extending through a series of commonly aligned fastening bores present in all of the body sublayers.

The appendage layer 44 of the leg assembly is attached at its proximate end 46 to the first layer 20 and third layer 32 with a second connector 42 and rotates between the first and third layer in an adjacent parallel plane. The distal end 48 of the appendage layer 44 has a distal bore 52 for being fitted with a third connector 58. Flanking the appendage layer 44 and also to be penetrated by the third connector 58 are two extremity layers 60, each having the same profile of a dinosaur foot. When the foot is assembled, a fourth connector 62 will extend through terminal bores 64 of the extremity layers 60 to prevent the extremity layers from rotating with respect to each other. Between the extremity layers 60 is a filler layer 36 having a slightly different profile than the extremity layers and a perpendicular bore 6. When the foot is assembled, the bore 6 of the filler layer is in alignment with the terminal bores 64 of the extremity layers and is penetrated between them by the fourth connector 62.

The slightly different profile of the filler layer 36 provides a rounded affect for the foot of the dinosaur model. The profile of the filler layer also includes stops 34 in proximity to the distal end 48 of the appendage layer. The two stops 34 of the filler layer 36 form an arc concentric with the profile of the rounded distal end 48 of the appendage layer 44 and thereby limit rotation of the foot about the third connector 58 by making contact with the appendage layer 44.

Figure 7:
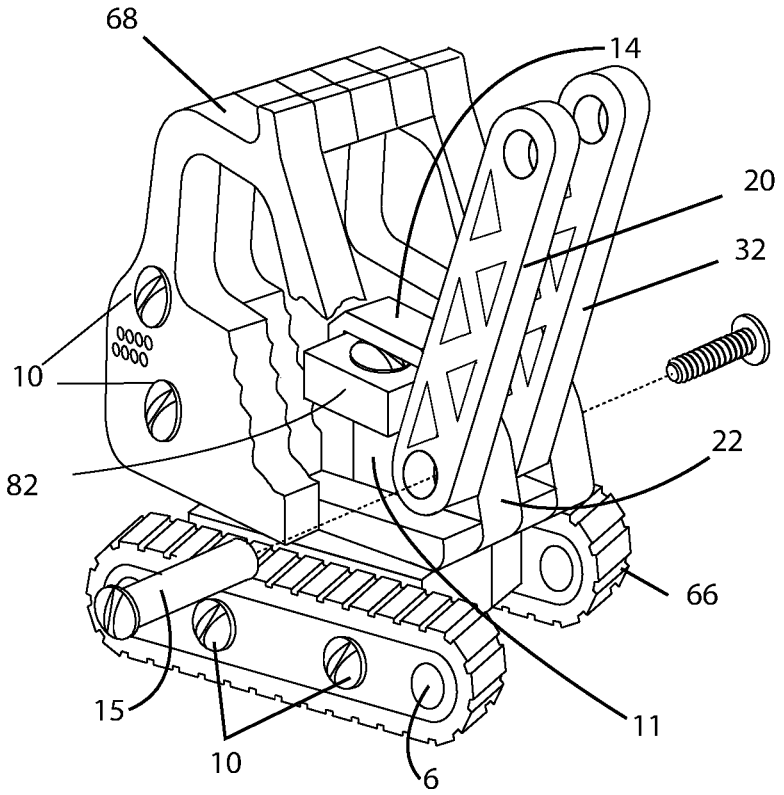
FIG. 7 is a multilayered model assembly of an excavator partly cut away to reveal a specialized connector.

Stratified layer assemblies of the present invention are useful for constructing a wide variety of models. Shown in FIG. 7 are parts of a toy model excavator. The model is comprised of stratified, planar layers held together with connectors. As with the dinosaur model assemblies previously described, some of the connectors in the excavator model allow layers to rotate in addition to holding the layers together.

The model excavator shown in FIG. 7 is comprised of a first part 66 representing the base of the excavator and a second part 68 representing the cab. The two parts are joined together by a swivel joint assembly.

The base 66 is comprised of stratified sublayers having perpendicular bores 6. The sublayer bores are in alignment and are fastened together with connectors 10 extending through some of the perpendicular bores. The stratified sublayers of the base do not rotate with respect to one another but are simply fastened together by the connectors 10.

The cab of the excavator model is also comprised of stratified sublayers running parallel to each other in adjacent planes and having perpendicular bores through which connectors 10 fasten the cab layer pieces together. The cab is shown fitted with part of a digging arm assembly having a first layer 20 and third layer 32, each with perpendicular bores. The perpendicular bores of the first and third layers are aligned and accept a pivoting connector 15. The cab functions as the second layer 22 of the digging arm assembly, having a midway sublayer 14 with a perpendicular bore through which the pivoting connector 15 extends, rotatably connecting the first layer 20 and the third layer 32 to the second layer 22 or midway sublayer 14 of the cab on an axis of rotation perpendicular to the planes of the stratified layers of the cab.

Referring to embodiments of the invention in general, certain model assemblies or subassemblies of the present invention are constructed with assemblies that rotate on an axis in the same plane as or parallel to assembly layer pieces.

Referring again to FIG. 7, a portion of the cab is cut away to expose one end of a specialized connector providing rotation on an axis in the same plane as the midway sublayer of the cab. The connector is parallel to other sublayers and attaches the cab of the excavator to the base, allowing the cab subassembly to swivel above and be joined with the base subassembly. The parallel connector 11 is specialized by having rotating washer blocks 82 on each end. The lower end of the parallel connector 11 is sandwiched between planar layers of the base part and the upper end of the connector 11 is sandwiched between planar layers of the cab part. The two ends of the connector 11 are captured in "T" shaped voids formed by the profiles of sublayers in each of the respective parts. The sublayers fit closely to the parallel connector ends and prevent the connector from pulling out from the cab and base.

Figure 8:
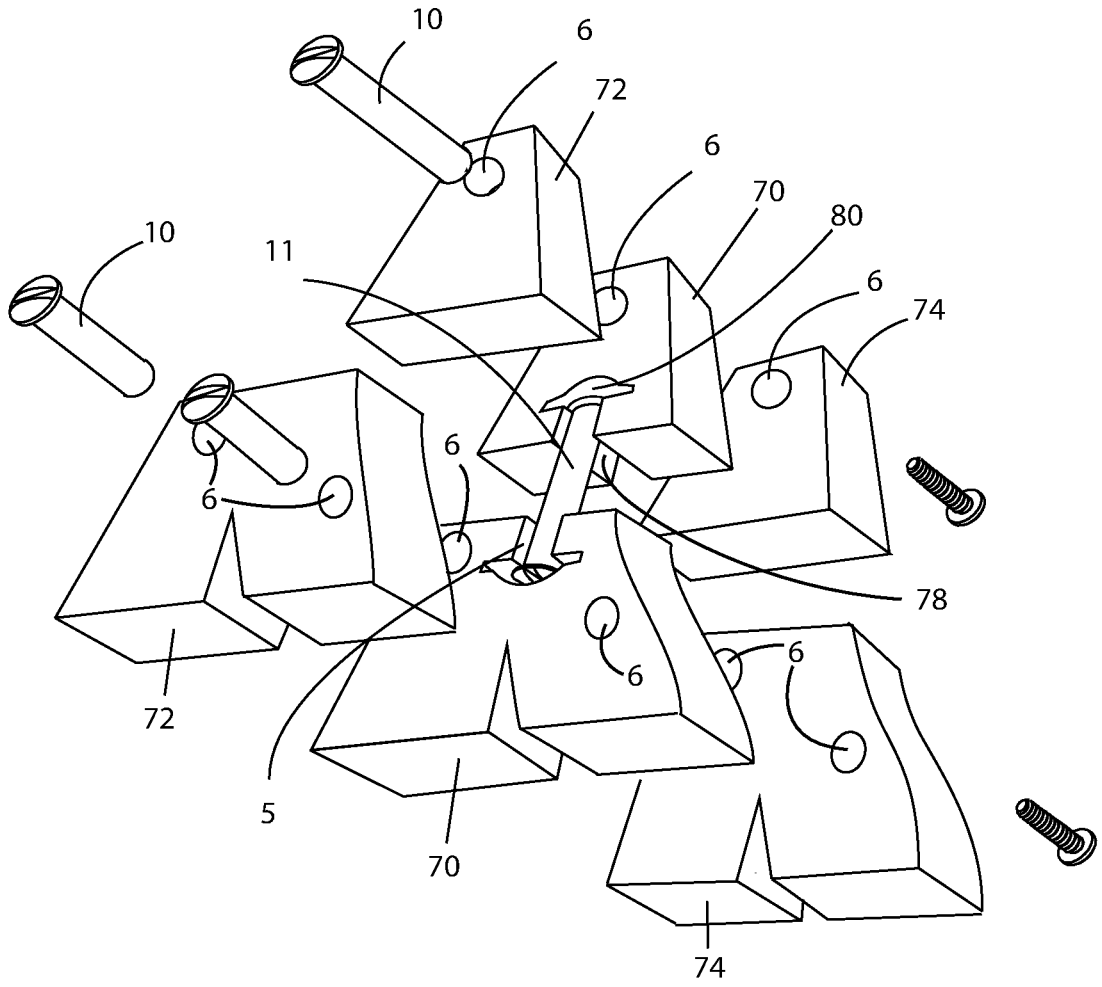
FIG. 8 shows two parts of a swivel joint rotatably connected, each part having multiple sublayers.

Shown now in FIG. 8 is an example of an assembly having a parallel connector 11 sandwiched between stratified planar layers of a first part and a second part. The subassemblies are each comprised of a primary layer 70 between a secondary layer 72 and a tertiary layer 74. The parallel connector 11 is in the same plane as the primary layers 70 of the subassemblies and the ends of the parallel connector are captured in "T" shaped voids 5 in the primary layers 70. Each "T" shaped void 5 of the primary layers 70 comprises an end opening 78 facing in the direction of the opposite subassembly and a side opening 80 that continues the end opening 78 around each side of the primary layer 70.

The primary, secondary, and tertiary layers of each subassembly comprise perpendicular bores 6 through which connectors 10 extend for fastening the layers together. With the secondary layers or tertiary layers removed, the parallel connector 11 may be fitted into the voids 76 of the primary layers. The parallel connector 11 is enclosed in the plane of the primary layers 70 when both secondary layers 72 and both tertiary layers 74 are fastened adjacent to the primary layers. With the parallel connector 11 rotatably secured within the primary layer of the first part and the primary layer of the second part, the stem of the parallel connector extends through the end openings of the "T" shaped voids, making one swivel joint assembly from the two subassemblies.

In preferred embodiments of the present invention, models having a swivel joint comprise a specialized connector. Such specialized connectors include a washer block 82 at each end that rotates about the stem of the specialized connector.

Figure 9:
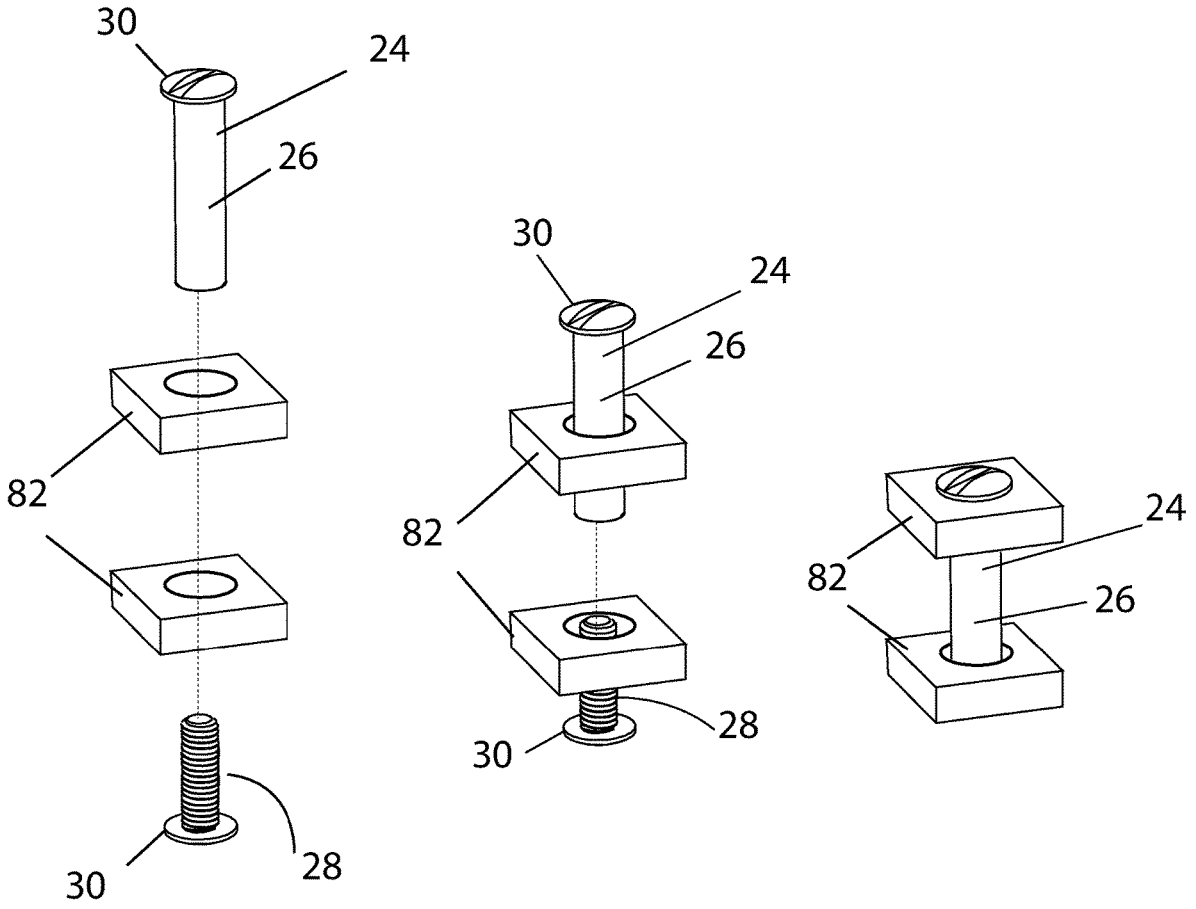
FIG. 9 illustrates components of a specialized connector in three stages of construction.

Shown in FIG. 9 are three of the same specialized connectors in progressive stages of construction. The connectors 84 are comprised of a barrel nut 24 and mating screw 28. The barrel nut 24 comprises an internally threaded stem 26 sufficiently long to extend through end openings of a pair of primary layers to be joined. The mating screw 28 comprises an externally threaded portion that engages with the threads of the barrel nut when the specialized connector is fully constructed.

Fitted along the stem 26 of a fully constructed connector shown in FIG. 9 are washer blocks 82. The washer blocks 82 each have a bore so that the washer block 82 may rotate about the connector stem 26. The barrel nut and mating screw of the connector each have slotted heads 30 wider in diameter than the stem 26 of the connector and the bore of the washer block, keeping the washer blocks 82 positioned on the stem 26.

When a specialized connector of the type shown in FIG. 9 is placed into "T" shaped voids of adjoining primary layers and the washer blocks 82 are captured in the voids, the washer blocks 82 rotate freely around the stem 26 of the specialized connector. Consequently, parts in which the adjoining primary layers are embodied are rotatably secured and swivel with respect to each other.

Figure 10:
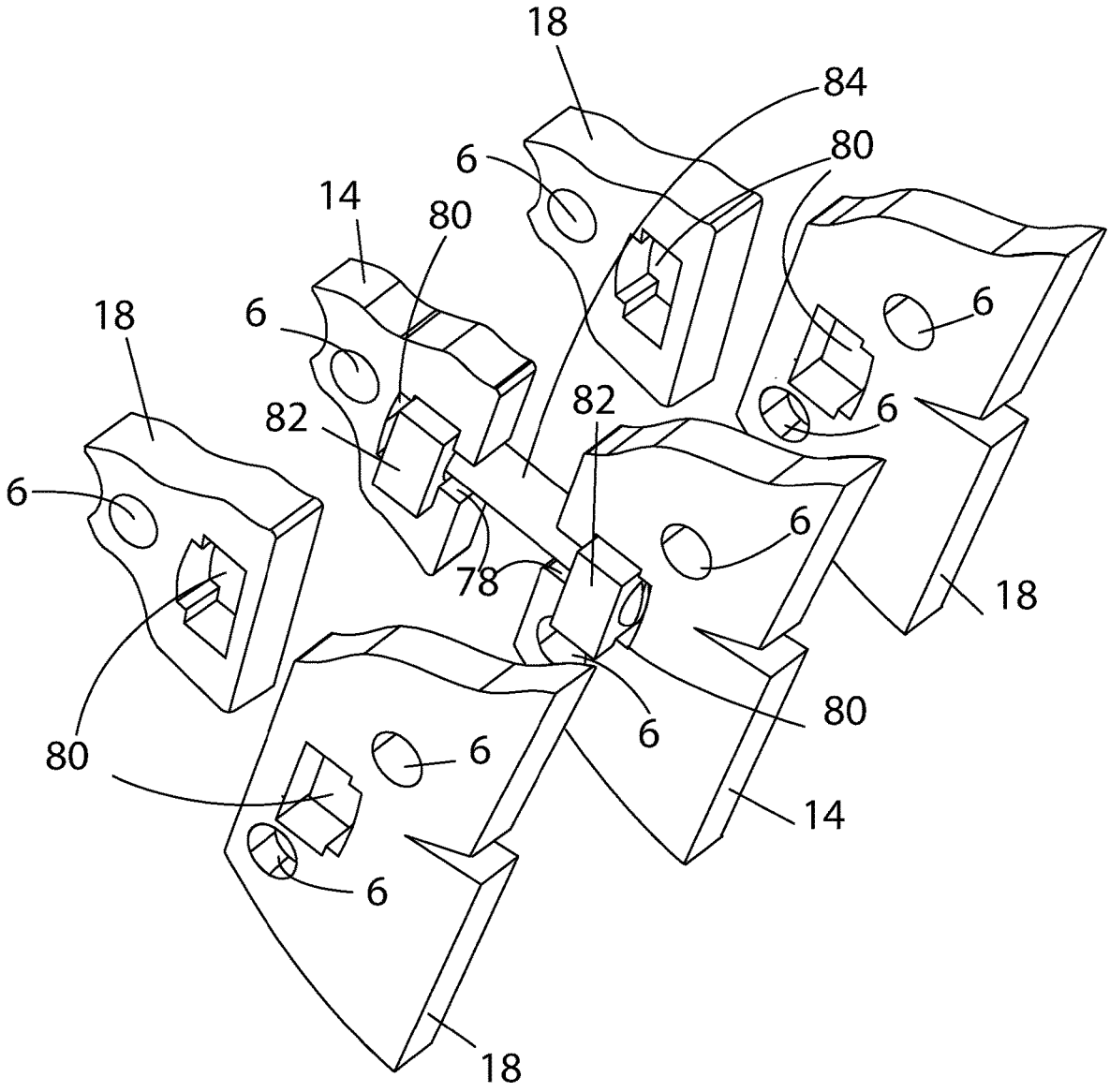
FIG. 10. illustrates a two-part primary layer of the swivel joint assembly having a specialized connector rotatably attaching the two parts.

In some preferred embodiments of the present invention, layer pieces of a model comprising a swivel joint are no more than ¼ of an inch thick and have swivel joint primary layers comprised of multiple sublayers. Shown in FIG. 10 are primary layers of a swivel joint assembly. The primary layers of the swivel joint are comprised of two parts. Each part is further comprised of three planar sublayers, fastened together with connectors extending through perpendicular bores 6 in each sublayer. A specialized connector 84 is positioned on an axis in the same plane as a midway sublayer 14 of each part and parallel to a pair of flanking sublayers 18 of each part. The specialized connector 84 includes a central stem and washer blocks 82 at opposite ends. The stem of the specialized connector extends through an end opening 78 of a "T" shaped void in the midway sublayer 14 of each part.

The "T" shaped voids of the midway sublayer of each part also include side openings 80 continuous with the end openings 78. The side openings 80 extend completely through each side of the midway sublayers 14. Individually, the three stratified sublayers of the two primary layers shown in FIG. 10 are not as thick as the washer blocks 82 of the specialized connector 84. Consequently, a portion of the washer blocks 82 in each part protrudes through the side openings 80 of their respective "T" shaped void. To fully capture the washer blocks, the side openings 80 in the "T" shaped void of the midway layer continue through the two flanking sublayers 18 of each part.

With the flanking sublayers 18 of the primary layers attached, the assembly may be further constructed with secondary and tertiary layers on each side (not shown) of the primary layers to fully enclose the swivel joint assembly. Each part of the swivel joint may be fastened to additional layers for rotatably securing parts of a model together.

In other embodiments, the side openings 80 of the "T" shaped void need not fully penetrate the flanking sublayers 18 of the primary layers, and the flanking sublayers may fully enclose the specialized connector 84 and washer blocks 82 without need of secondary and tertiary layers. In still other embodiments having thicker layers, the end openings of the "T" shaped voids need not penetrate the layers or sublayers flanking a midway layer at all. Instead, the flanking layers may be entirely flat with respect to the swivel joint assembly and have only perpendicular bores for fastening in a stratified layer manner.

In embodiments of a model displaying a rounded component in which a swivel joint is used, primary, secondary, and tertiary layers or sublayers may be cut to differ slightly in profile and be arranged in mirrored form to provide a rounded appearance.

Figure 11:
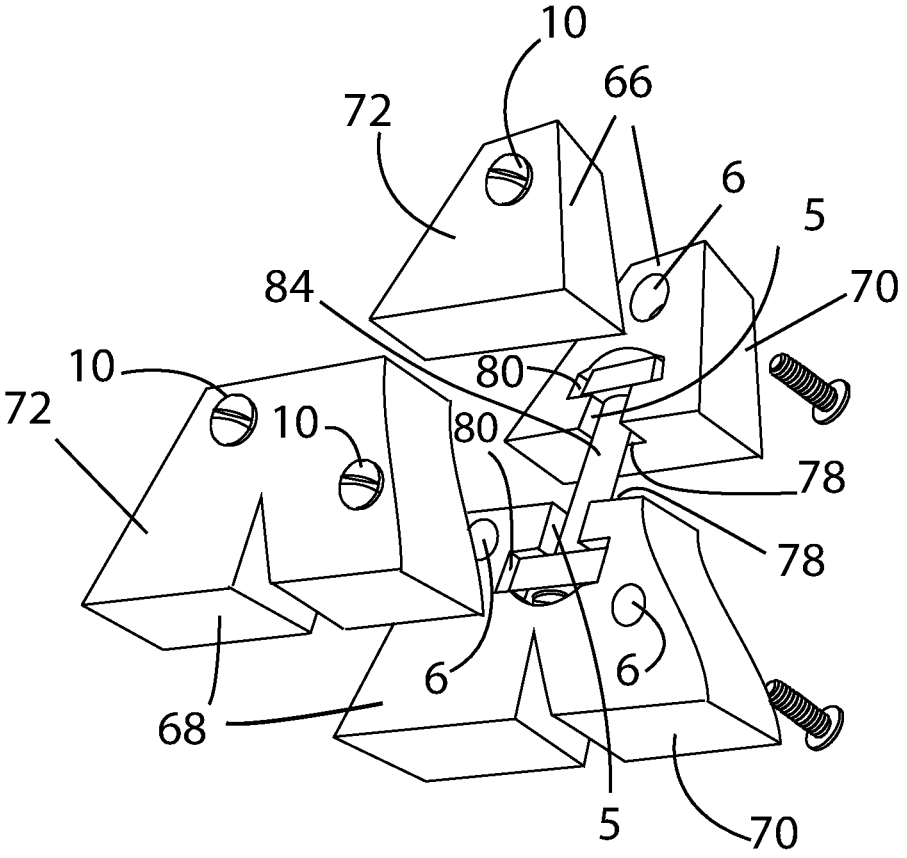
FIG. 11 illustrates primary and secondary layers of a two-part swivel joint assembly.

Another embodiment of a swivel joint assembly may be used with various types of models but is particularly useful for models constructed of assemblies having fewer planar layers. In this embodiment, a specialized connector having rotating washer blocks is enclosed by secondary layers on a single side of primary layers being joined. As shown in FIG. 11, a swivel joint assembly is comprised of a first part 66 and a second part 68. Each of the two parts has a single primary layer 70 and a single secondary layer 72. The primary and secondary layers of each part comprise perpendicular bores 6 through which connectors 10 extend for fastening the primary and secondary layers together.

In the primary layer 70 of each part is a "T" shaped void 5, having a single end opening 78 and a single side opening 80. The end openings and side openings are completely contained in the primary layers. A specialized connector 84 joins the primary layers, as each end of the specialized connector 84 is captured by its respective "T" shaped void 5.

With the secondary layers 72 removed, the specialized connector 84 may be placed in and out of the side openings of the "T" shaped voids of the primary layers 70 from one side only. With the specialized connector 84 placed within the voids 5, and both secondary layers 72 fastened adjacent to the primary layers 70, all but the stem of the specialized connector is fully enclosed. When completely assembled, the stem of the specialized connector 84 extends through the end openings 78 of the "T" shaped voids of the primary layers, making one swivel joint assembly from the two subassembly parts. As with other swivel joint assemblies, the axis of the specialized connector 84 is in the same plane as the primary layers 70.

Layer pieces of kits and models of the present invention may be manufactured from a variety of materials but are preferably made from wood. Most preferably, quality plywood sheets are cut with a laser cutter and include ornamentation created using a laser engraving function. Alternatively, layer pieces may be cut from solid wood. In some embodiments, punch and die tooling may be used to cut layer pieces from low density or thinner plywood sheets.

Punch and die tooling may also be used to cut layer pieces from foam, cardboard, or other synthetic materials, preferably after the materials have been printed with ornamentation. Alternatively, all of the mentioned materials may be cut and inscribed with a CNC router. Layer pieces of the present invention may also be made from sheets of metal cut with a laser, plasma cutter, or CNC end mill.

Another useful method for manufacturing layers of the present invention is plastic injection molding. Preferably, the internal cavity of the plastic parts is oriented to face toward the center of the model, allowing the outer surfaces of finished layer pieces to appear mostly smooth and solid.

Connectors used with kits and model assemblies of the present invention include a central stem and may have grooves for caps or threads to accept nuts or screws at either end. Connectors used for making pivoting connections are adjustable for length to provide a clamping force and layers rotating about the pivot connector. Preferably, threaded, adjustable length connectors of the present invention comprise relatively flat heads at opposite ends. The heads of such connectors may be shaped as knobs or nuts or adapted to be driven by slotted, phillips, allen, hex, square, torx and similar type tools. Such connectors may be readily obtained from numerous hardware suppliers.

Figure 12:
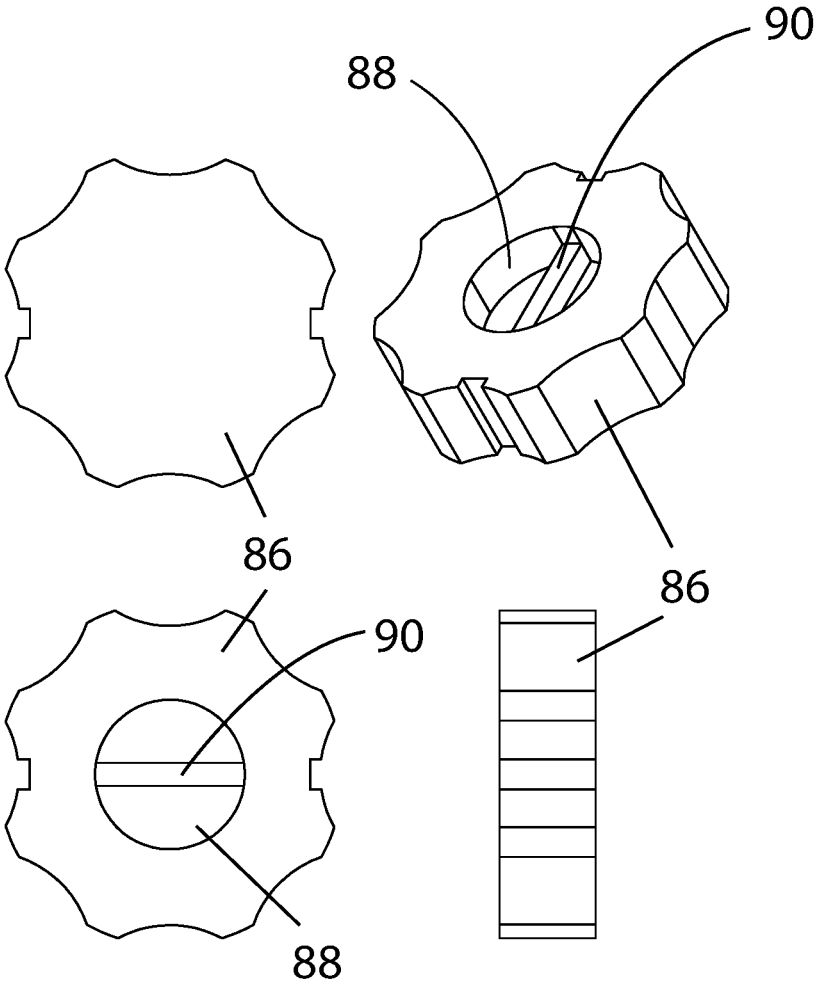
FIG. 12 shows a multilayered model assembly tool for connectors having a slotted barrel nut and mating screw at opposite ends.

Model assemblies of the present invention may be constructed by hand or with tools, depending on the type of connectors used. Kits having connectors with flat head screw type heads may include a model assembly tool. Shown in FIG. 12 are multiple views of a model assembly tool for slotted barrel nut and mating screw type connectors. The tool comprises a planar tool body 86 having a central recess 88 open to one side of the body. The recess 88 is sized to match the size and shape of a connector head for which the tool is intended, having a diameter only slightly larger than the diameter of the connector head. A blade portion 90 within the recess is sized and positioned to engage with the slot. Preferably, the tool is made of wood and included as an item in a perforated sheet with layer pieces provided by the kit. In other embodiments, the tool may be provided separately and made of wood, metal, plastic or a composite material.

The above description is intended to enable a person of skill in the art to make and use the present invention in any combination of features that provides one or all the functions of the present invention. It is intended that the scope of the invention be understood to include all combinations of variations and modifications of embodiment features disclosed in the drawings, specification, and claims.

What is claimed is:

1. A model assembly of stratified planar layers comprising:

a first layer having two sides, said first layer having a profile and containing a bore;

a second layer having two sides, said second layer having a profile and containing a bore, wherein the bore of the first layer and the bore of the second layer are aligned and perpendicular to the first layer and the second layer, wherein the second layer is comprised of multiple sublayers and the sublayers differ in profile shape, the second layer further comprising at least one fastening bore;

a first connector of suitable length extending through the bores and rotatably connecting the first layer and second layer, said connector having a central stem with heads at opposite ends, said connector being adjustable in length to impart a clamping force on the layers when tightened, wherein the first layer and the second layer slide against each other in adjacent parallel planes when rotating about the connector stem and whereby reducing the length of the connector impedes rotation of the first layer with respect to the second layer; and a third layer, said third layer having a profile and containing a bore, wherein the first connector extends through the bore of the third layer, connecting the third layer alongside the second layer, wherein the first layer and the third layer rotate about the connector stem with respect to the second layer;

one or more filler lavers each having a bore in alignment at with said fastening bore of the second layer; and a fastening connector, said one or more filler layers fixed adjacent to at least one of the two sides of the second layer by the fastening connector, wherein the one or more filler layers further comprises one or more stops in the same plane as the first layer or third layer, thereby limiting rotation of the first layer and third layer.

2. The model assembly of claim 1, further comprising: a second bore of the first layer in alignment with a second bore of the third layer; and a second connector, said second connector being adjustable for length and extending through the second bore of the first layer and the second bore of the second layer, wherein the first layer and the third layer are prevented from rotating with respect to each another.

3. The model assembly of claim 1 wherein the one or more filler layers has a different profile than the second layer.

4. The model assembly of claim 1 wherein the stops of the one or more filler layers form an arc concentric with a rounded profile end of the first or third layer.

5. The model assembly of claim 1 wherein at least one connector is comprised of a barrel nut and a mating screw, each of said barrel nut and matting bolt having a head.

6. A model assembly of stratified planar layers comprising:

a first layer having two sides, said first layer having a profile and containing a bore;

a second layer having two sides, said second layer having a profile and containing a bore, wherein the bore of the first layer and the bore of the second layer are aligned and perpendicular to the first layer and the second layer, wherein the second layer is comprised of multiple sublayers and the sublayers differ in profile shape;

a first connector of suitable length extending through the bores and rotatably connecting the first layer and second layer, said connector having a central stem with heads at opposite ends, said connector being adjustable in length to impart a clamping force on the lavers when tightened, wherein the first layer and the second layer slide against each other in adjacent parallel planes when rotating about the connector stem and whereby reducing the length of the connector impedes rotation of the first layer with respect to the second layer;

a third layer, said third layer having a profile and containing a bore, wherein the first connector extends through the bore of the third layer, connecting the third layer alongside the second layer, wherein the first layer and the third layer rotate about the connector stem with respect to the second layer;

an appendage layer, said appendage 1*a* having a proximate end and a distal end, said appendage layer having a proximate bore at the proximate end, said proximate bore in alignment with and rotating about the second connector said appendage layer rotating in the same plane as the second layer;

a distal bore at the distal end of the appendage layer, said distal bore fitted with a third connector;

two or more extremity layers each having a profile and a proximate bore and a terminal bore, said proximate bores of the two or more extremity layers in alignment with and flanking the distal bore of the appendage layer, said extremity layers fitted along the third connector and rotatably connected to the appendage layer, said terminal bores distal to said proximate bores along the extremity layers; and a filler layer in contact with and fitting between the extremity layers, said filler layer having a bore in alignment with the terminal bores of the extremity layers, said filler layer and the distal layers secured together with a fourth connector, wherein the filler layer further comprises a stop in the same plane as the appendage layer, thereby limiting rotation of the extremity layers with respect to the appendage layer.

7. The model assembly of claim 6 wherein the extremity layers and the filler layer have different profiles.

8. A model assembly of stratified planar layers comprising:

a first part with multiple layers, said first part having a primary layer containing a "T" shaped void, said "T" shaped void having an end opening and at least one side opening; a second part with multiple layers, said second part having a primary layer containing a "T" shaped void, said "T" shaped void having an end opening and at least one side opening;

a connector having a rotating washer block at each end, said connector adapted to fit through the end opening of each primary layer; and a secondary layer fastened against the side opening of the primary layer of the first part, and a separate secondary layer fastened against the side opening of the primary layer of the second part, thereby capturing the washer blocks in the voids of the primary layers of each part, wherein the primary layer of the first part is co-planar with the primary layer of the second part and whereby the first part is rotatably secured with respect to the second part.

9. The model assembly of claim 8 wherein the "T" shaped voids of the primary layers each further comprise a second side opening and a separate tertiary layer is fastened against the second side opening of each primary layer.

10. The model assembly of claim 9 wherein the primary layer comprises multiple sublayers.

11. The model assembly of claim 10 wherein the secondary and tertiary layers are comprised of multiple sublayers.

12. The model assembly of claim 11 wherein the sublayer profiles are repeated in mirrored form.

13. The model assembly of claim 10 wherein the sublayers differ in profile.

* * * * *